US009580992B2

(12) United States Patent
Stolboushkin

(10) Patent No.: US 9,580,992 B2
(45) Date of Patent: Feb. 28, 2017

(54) SEALING DEVICE HAVING HIGH DIFFERENTIAL PRESSURE OPENING CAPABILITY

(71) Applicant: Eugene Stolboushkin, Houston, TX (US)

(72) Inventor: Eugene Stolboushkin, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 174 days.

(21) Appl. No.: 14/199,288

(22) Filed: Mar. 6, 2014

(65) Prior Publication Data

US 2015/0252907 A1 Sep. 10, 2015

(51) Int. Cl.
*E21B 34/06* (2006.01)
*E21B 43/14* (2006.01)

(52) U.S. Cl.
CPC ..... *E21B 34/06* (2013.01); *E21B 43/14* (2013.01); *Y10T 137/86879* (2015.04)

(58) Field of Classification Search
CPC ..... E21B 34/06; E21B 43/14; E21B 34/10; Y10T 137/86879; F16J 15/16; F16J 15/18
USPC ..... 251/229, 324–325; 166/321; 137/625.48
See application file for complete search history.

(56) References Cited

U.S. PATENT DOCUMENTS 1,312,644 A * 8/1919 Raab et al. ..... F16K 17/00 137/464
2,192,945 A * 3/1940 Toney ..... E21B 34/16 251/354
2,417,494 A * 3/1947 Hoof ..... F16K 1/34 251/332
2,656,144 A * 10/1953 Frantz ..... F16K 3/26 251/332
3,485,371 A * 12/1969 Costantini ..... B01D 35/046 137/614.2
3,497,004 A * 2/1970 Page, Jr. ..... E21B 34/06 166/322
3,589,397 A * 6/1971 Wagner ..... F16K 1/305 137/384.2
3,637,223 A 1/1972 Weber
3,649,032 A 3/1972 Nelson
3,900,223 A 8/1975 Schafer et al.
4,188,971 A * 2/1980 Otteson ..... F16K 17/34 137/460
4,522,223 A * 6/1985 Balsys ..... F16K 1/446 251/332

(Continued)

FOREIGN PATENT DOCUMENTS

EP 0836041 A1 4/1998

*Primary Examiner* — John Bastianelli

(74) *Attorney, Agent, or Firm* — Cantor Colburn LLP

(57) ABSTRACT

A sealing device is used in a flow control apparatus, the sealing device including a static seal and a protective seal or fluid restriction. The protective seal is formed between two members formed from resilient materials being substantially resistant to wear or failure when exposed to large pressure differentials and associated jetting action. The static seal is formed using a sealing element that includes a material that is at least partially deformable, such as an elastomer or the like. The protective seal is engaged prior to engaging or disengaging the static seal in order to prevent damage to the deformable material of the static seal.

18 Claims, 8 Drawing Sheets

(56) References Cited

U.S. PATENT DOCUMENTS

| | | | | |
|---|---|---|---|---|
| 4,700,742 | A * | 10/1987 | Rosaen | F16K 17/32 116/275 |
| 5,067,520 | A * | 11/1991 | Kremer | F16K 1/302 137/614.17 |
| 5,862,866 | A | 1/1999 | Springer | |
| 6,173,795 | B1 * | 1/2001 | McGarian | E21B 21/10 166/321 |
| 6,446,717 | B1 | 9/2002 | White et al. | |
| 6,675,897 | B1 * | 1/2004 | McGarian | E21B 21/103 166/151 |
| 7,207,348 | B2 * | 4/2007 | Fouillet | F16K 17/0486 137/466 |
| 7,337,847 | B2 * | 3/2008 | McGarian | E21B 21/103 166/331 |
| 8,272,445 | B2 * | 9/2012 | Fay | E21B 23/006 137/625.48 |
| 8,276,676 | B2 | 10/2012 | Hriscu et al. | |
| 2013/0284451 | A1 * | 10/2013 | Merron | E21B 43/26 166/373 |

* cited by examiner

SEALING DEVICE HAVING HIGH DIFFERENTIAL PRESSURE OPENING CAPABILITY

BACKGROUND

Sliding sleeves, circulating valves, and other oilfield tools are used to selectively open and close communication between adjacent flow paths. Frequently, these tools are opened across high differential pressures, which often create a powerful jetting action. Such a jetting action can potentially destroy sealing elements, which are typically formed of an elastomer or similarly deformable material to create a sufficient sealing surface. Such elastomers are resilient to static differences in pressure but are susceptible to wear and/or failure in the presence of jetting action. Other, non-elastomer seals are more resilient to jetting action but are generally very expensive and prone to slow leakage. As such, the art welcomes sealing devices that improve seal durability and reliability.

SUMMARY

Disclosed herein is a sealing device for separating fluid volumes that comprises a housing having one or more openings and a flow control element having one or more sealing elements arranged thereon in contact with the housing. The flow control element is arranged with the housing and configured to move relative to the housing to selectively permit fluid communication between a first fluid volume and a second fluid volume. The A protective member is arranged to engage the flow control element, thereby restricting fluid communication between the first fluid volume and the second fluid volume. The device further comprises a biasing member arranged to bias the relative positions of the flow control element and the protective member.

Also disclosed herein is a flow control apparatus that comprises a housing having one or more openings and a flow control element having one or more sealing elements. The flow control element is arranged with the housing and configured to move between a closed position and an open position, respectively restricting and permitting fluid communication between a first fluid volume and a second fluid volume. A protective member is arranged to engage the flow control element, thereby restricting fluid communication between the first fluid volume and the second fluid volume. The device further comprises a biasing member arranged to bias the relative positions of the flow control element and the protective member.

Also disclosed herein is a method for controlling fluid communication between fluid volumes. The method employs a flow control device comprising a housing with one or more openings and a flow control element with one or more ports having one or more sealing elements arranged in contact with the housing. The flow control element is forcibly engaged with a protective member, thereby restricting fluid communication. The flow control element and protective member are then moved, with the one or more sealing elements traversing the one or more openings of the housing. The protective member and the flow control element are then disengaged.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures. It is to be understood that other embodiments may be utilized and changes may be made without departing from the scope of the present disclosure. In particular, the disclosure provides various examples related to a sealing device for use in well operations, whereas the advantages of the present disclosure as applied in a related field would be apparent to one having ordinary skill in the art and are considered to be within the scope of the present invention. As will be further described below, the sealing device is used in a flow control apparatus, the sealing device including a static seal and a protective seal or fluid restriction. The protective seal is formed between two members formed from resilient materials being substantially resistant to wear or failure when exposed to large pressure differentials and associated jetting action. The static seal is formed using a sealing element that includes a material that is at least partially deformable, such as an elastomer or the like. The protective seal is engaged prior to engaging or disengaging the static seal in order to prevent damage to the deformable material of the static seal.

Figure 1:
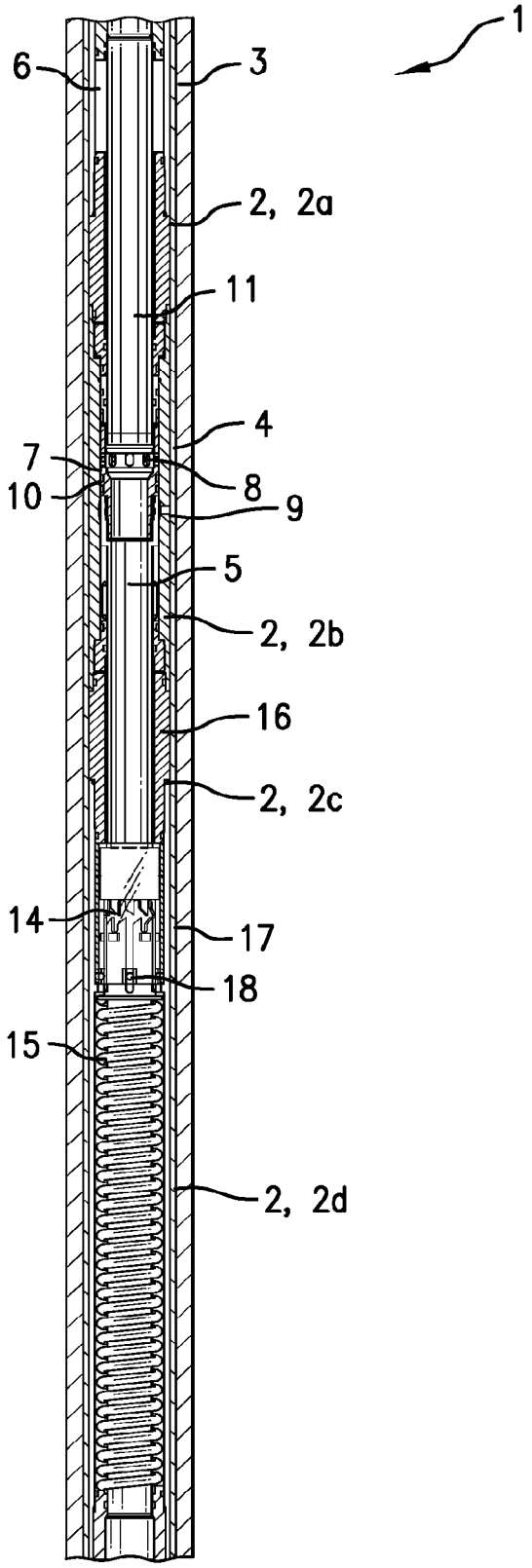
FIG. 1 is a partially sectioned side view of a flow control apparatus according to one embodiment.
Figure 2:
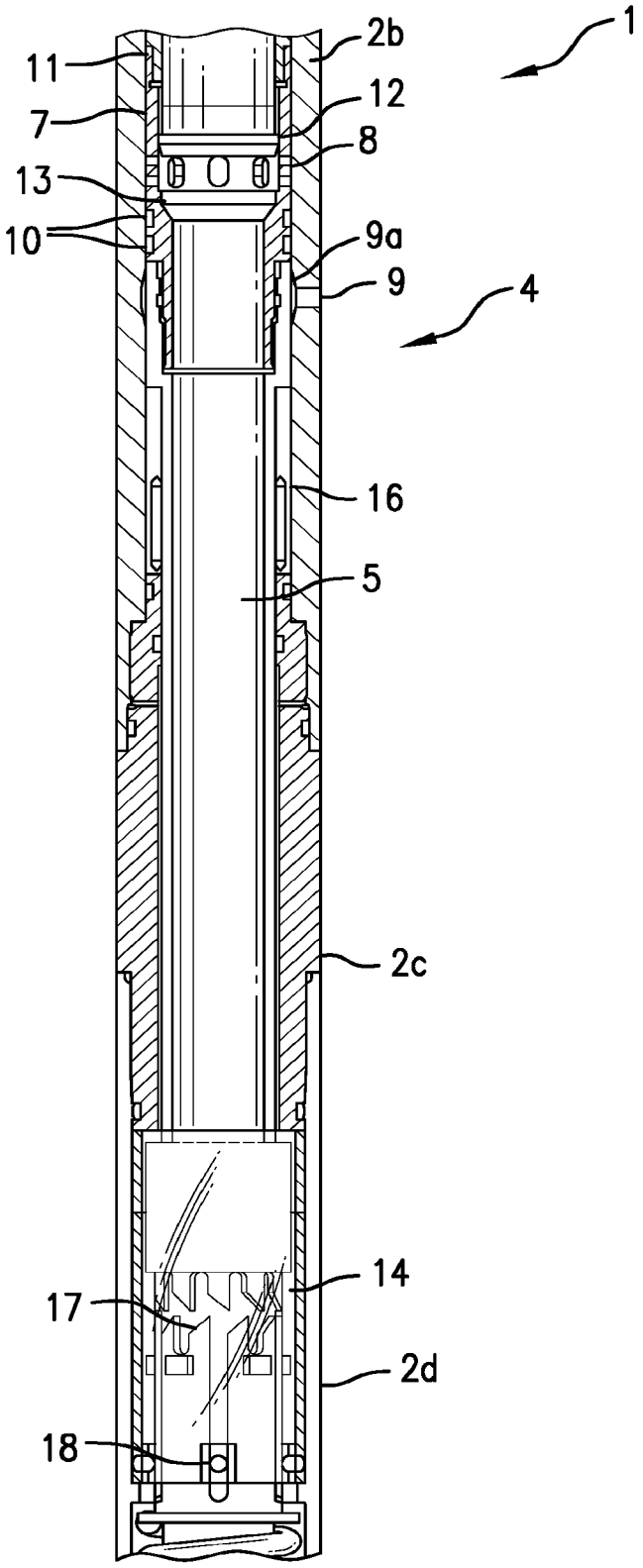
FIG. 2 is a detailed view of the flow control apparatus depicted in FIG. 1.

FIGS. 1 and 2 illustrate one embodiment of a valve 1 according to the present disclosure. The valve 1 comprises a housing 2 segmented into one or more sections 2*a*, 2*b*, 2*c*, 2*d*, as shown, to provide easy assembly of the valve 1. In FIG. 1, the valve 1 is disposed in the bore of a tubular 3. An annular space 4 is formed between the housing 2 and the tubular 3, defining a first fluid volume. An internal bore 5 of the housing 2 defines a second fluid volume that is isolated from the first fluid volume by the valve 1. The internal bore 5 of the housing 2 is fluidly connected to one or more additional fluid volumes or passageways, such as isolation pipe 6, which may also form a part of the second fluid volume.

The valve 1 further comprises a flow control element 7, comprising a sleeve, that is arranged with and moves relative to the housing 2. The flow control element 7 shown in FIGS. 1 and 2 includes one or more ports 8 that are configured to align with one or more openings 9 in the housing 2 to close or open the valve 1, respectively, (see FIGS. 1 and 4). One or more sealing elements 10, such as o-rings, provide a static seal between the ports 8 in the flow control element 7 and the openings 9 in the housing 2 when the valve 1 is closed (see FIGS. 1 and 2). The openings 9 in the housing 2 may be formed with a relief 9*a*, to avoid contacting the sealing elements 10 with an abrupt edge (see FIG. 2).

A protective member 11 is configured to move relative to the housing 2, independently of the flow control element 7. The motion of the protective member 11 may be controlled mechanically or hydraulically. One end of the protective member 11 is formed with a contact surface 12 which is formed in a shape to form a protective seal with a seat 13 formed in the flow control element 7, (See FIG. 3). As used herein, the term "protective seal" encompasses fluid restrictions, as well as seals, where the engagement of the contact surface 12 and the seat 13 is sufficient to maintain a selected pressure difference between adjacent fluid volumes. In the embodiment shown in FIG. 1, the protective member 11 is a hollow tubular, connecting the isolation pipe 6 with the internal bore 5 of the housing 2. In alternative embodiments, such as where the second fluid volume extends in an opposite direction, the protective member 11 may be a solid structure.

Figure 3:
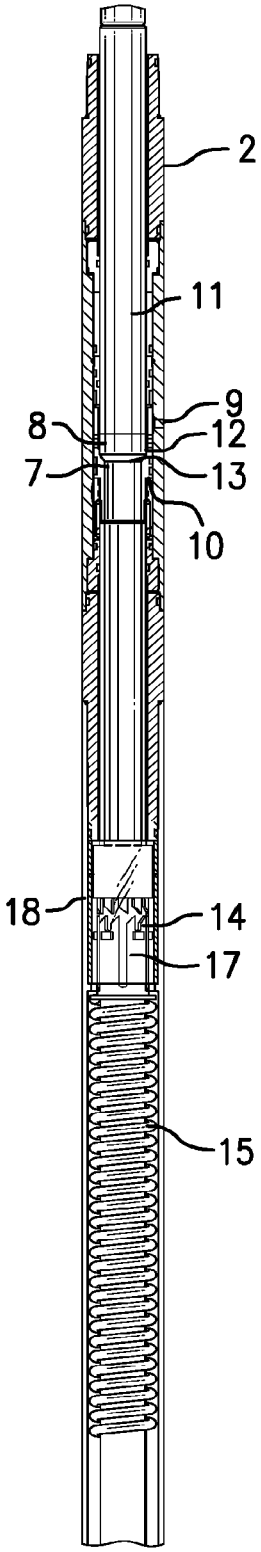
FIGS. 3 and 4 are partially sectioned side views of the flow control apparatus of FIG. 1 in different positions.
Figure 4:
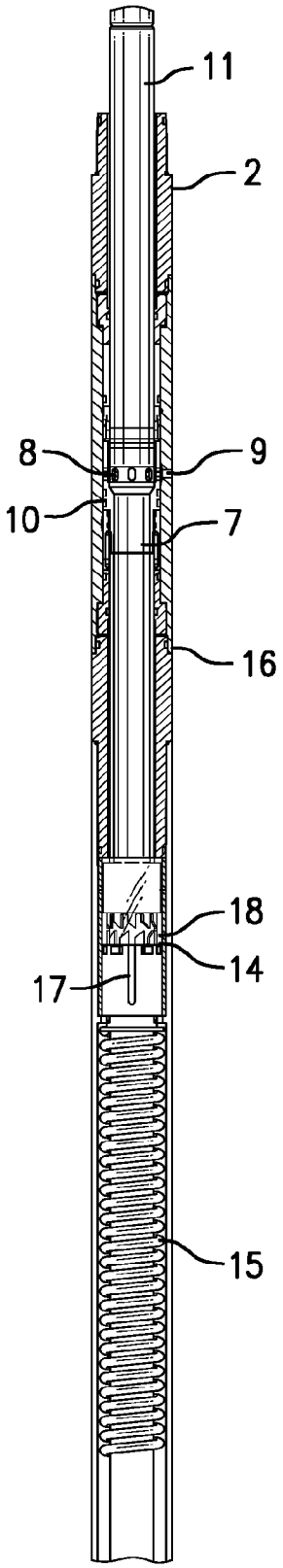
Figure 5:
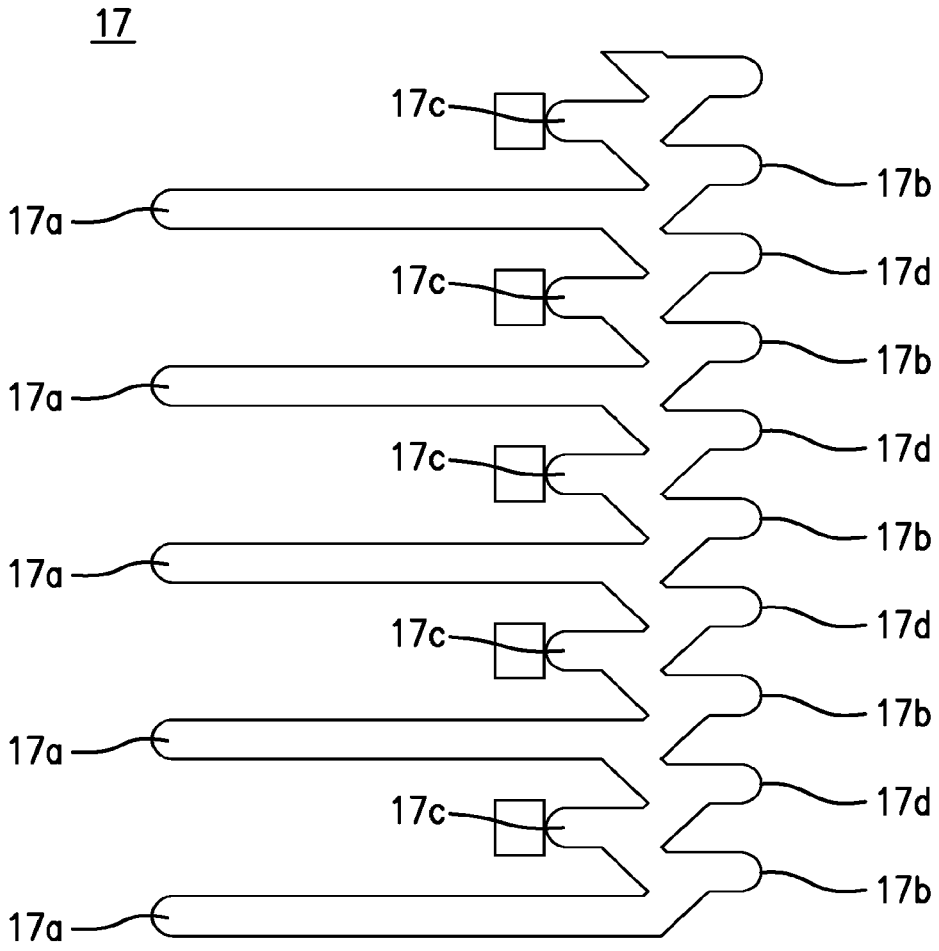
FIG. 5 is a schematic of a guide track according to one embodiment.

The valve 1 also comprises a positioning device 14 and a biasing member 15, such as a coiled spring or a liquid spring, for regulating the motion of the flow control element 7. A connecting member 16 is arranged between the positioning device 14 and the flow control element 7. The positioning device 14 comprises a guide track 17 and one or more guide pins 18 arranged to translate and rotate relative to one another to regulate the motion of the flow control element 7 within the valve 1. FIGS. 3-4 show the valve 1 of FIGS. 1 and 2 in different positions during operation and FIG. 5 shows the guide track 17 of the embodiment illustrated by the figures. The guide track 17 is depicted in a linear configuration in FIG. 5, though, as will be understood by others in the relevant field, the guide track 17 may be arranged circumferentially on the positioning device 14, as shown, for example, in FIG. 2. Alternatively, the positioning device 14 could be any one of a number of devices known in the art, such as for example, a j-slot mechanism, a fixed pin mechanism, a turning mandrel, or the like.

FIGS. 1 and 2 depict the valve 1 in a closed position, where the one or more openings 9 in the housing 2 are obstructed by the flow control element 7 and are isolated from the ports 8 in the flow control element 7 by the one or more sealing elements 10. In a downhole application, the differential pressure between the first fluid volume and the second fluid volume may be as much as about 1500 psi or greater, or as much as about 15000 psi or greater, when the valve 1 is closed, with either fluid volume exhibiting the larger pressure. Also, with the valve 1 in the closed position, the guide pin 18 resides in a closed position 17*a* of the guide track 17. (See FIG. 5).

In order to open the valve 1, the protective member 11 is forcibly engaged with the flow control element 7, thereby obstructing the ports 8. When the protective member 11 is forced against the flow control element 7 with enough force to compress the biasing member 15, the contact surface 12 forms a protective seal against the seat 13. FIG. 3 depicts the valve 1 with the protective member 11 forced against the flow control element 7 and compressing biasing member 15. In order to open the valve 1, the flow control element 7 must be moved until the guide pin 18 reaches a "stroke-to-open" position 17*b* in the guide track 17. (See FIG. 5). With the protective seal engaged, the sealing elements 10 are able to traverse the one or more openings 9 without damage. In some embodiments, for example, the valve 1 is configured to permit the sealing elements 10 to traverse the one or more openings 9 only when the protective seal is engaged, i.e., with the protective member forced against the flow control element 7 with a force sufficient to compress the biasing member 15. The force required to compress the biasing member 15 may be configured to be equal to or greater than the force required to maintain a sufficient protective seal or fluid restriction between the contact surface 12 and the seat 13.

In the embodiment discussed above, the biasing member 15 is preloaded to achieve a required compression force that is greater than or equal to the force to sufficiently seat the protective seal. In this manner, the protective seal separates the first fluid volume of the annular space 4 from the second fluid volume of the internal bore 5, even when the openings 9 are aligned with the one or more ports 8 of the flow control element 7. This arrangement prevents the sealing elements 10 from being subjected to a pressure differential when traversing the one or more openings 9. Alternatively, the valve 1 may be constructed without biasing the biasing member 15, as it may not be necessary depending on the configuration. Further, the biasing member 15 may be assembled with the valve 1 without preloading, but may be preloaded at a later time, including at the time of installation or even later, using a mechanical tool to preload the device and to set the positioning device or another mechanism to maintain the loading of the biasing member 15.

The arrangement as described above is sufficient to prevent differential pressures from damaging the sealing elements 10. Depending on the tolerances within the system, a portion of the pressure differential can be seen by the sealing elements 10 when traversing the one or more openings 9. This effect is substantially mitigated by minimizing an intermediate volume that exists between the static seal formed by the sealing elements 10 and the protective seal formed by the contact surface 12 and the seat 13. Because very little fluid will traverse the sealing elements 10 to fill or empty the intermediate volume, as the case may be, the sealing elements 10 will be sufficiently protected from damaging jetting action. When the intermediate volume between the protective seal and the static seal is equalized with the pressure in the second fluid volume, the sealing elements 10 are not exposed to a further pressure differential when the protective seal is disengaged. In one example, about 50% or more of the intermediate volume between the protective seal and the static seal comprises the volume defined by the size and shape of the ports in the flow control element. In another example, the intermediate volume is about 3 cubic inches or less. In a further example, the intermediate volume is substantially eliminated.

The contact surface 12 of the protective member 11 and the seat 13 of the flow control element 7 are formed of a resilient material that is substantially resistant to damage from differential pressures. In some examples, the resilient material is a substantially non-deformable material, such as a metal, a ceramic, a polymer, or another resilient material. Because of the resilient materials, the protective seal may leak some fluid in some embodiments. However, with the contact surface 12 and seat 13 engaged with enough force to at least partially overcome the biasing member 15, the protective seal is sufficient to prevent the pressure differential from causing jetting action in the area of the sealing elements 10 because the flow rate entering the intermediate volume will be limited. Further, any fluid loss through the protective seal will be substantially insignificant, since the protective seal is only engaged when the valve 1 is in the process of being opened or closed. In further embodiments, the contact surface 12 and/or the seat 13 includes a surface comprising a material that is deformable under the load, but which is resilient the expected jetting action.

The valve of the present disclosure is configured to protect the sealing elements 10 when opening or closing the valve 1 in the presence of high differential pressures. In order to protect the sealing device 10 in both opening and closing the valve, and in order to provide that protection when either the first fluid volume or the second fluid volume exhibits a higher fluid pressure, the area of the protective seal, formed by the contact surface 12 and the seat of the flow control element 7, can be formed to have an area substantially similar to or equal to the area defined by the sealing surface of the sealing elements 10. This feature will further help to limit the amount of flow into the intermediate volume in a given operation. Alternatively, the ratio of the area of the protective seal to the area of the sealing elements 10 may be selected for a particular set of conditions. For example, in one application, the valve 1 may be configured with a protective seal having an area substantially smaller than the sealing elements 10 where the application discourages or does not require the valve 1 to be opened when one fluid volume exhibits relatively high pressures in comparison with another fluid volume.

With the valve 1 in the stroke-to-open position shown in FIG. 3, the protective seal can be disengaged to open the valve 1 without exposing the sealing elements 10 to extreme differential pressures and jetting action. The protective member 11 is withdrawn from the flow control element 7, hydraulically, mechanically, or otherwise, until reaching the open position shown in FIG. 4. The contact surface 12 and the seat 13 remain in contact by virtue of the biasing member 15 until the guide pin 18 reaches the "open" position 17*c* in the guide track 17. (See FIG. 5). As the pressure differential overcomes the protective seal, in either direction, jetting action may occur at the protective seal but will have substantially no effect on the contact surface 12 or the seat 13 because of the resilient materials chosen. Further removing the protective member 11 to fully expose the ports 8 to the internal bore 5 and limit any obstruction of flow will reduce pressure losses between the first and second fluid volumes when fluid is flowing between the two fluid volumes.

With the valve 1 in the open position shown in FIG. 4, the valve can be closed again by substantially repeating the steps above. For example, the contact surface 12 of the protective member 11 is forced against the seat 13 of the flow control element 7, compressing the biasing member 15 as shown in FIG. 3, and engaging the protective seal. When closing the valve 1, the intermediate volume between the protective seal and the static seal is already equalized with the second fluid volume. In this instance, the guide pin 18 moves from the open position 17*c* to the "stroke-to-close" position 17*d*.

With the valve 1 in the "stroke-to-close" position 17*d*, the valve may be closed by withdrawing the protective member 11 from the flow control element 7. The biasing member 15 keeps the seat 13 in contact with the contact surface 12 until the guide pin 18 reaches the closed position 17*a* in the guide track 17. (See FIG. 5). The valve 1 is again in the closed position illustrated in FIGS. 1 and 2. Any pressure differential between the intermediate volume and the first fluid volume will begin to bleed through the protective seal as the force between the contact surface 12 and the seat 13 decreases and is finally disengaged. No fluid flow traverses the sealing elements 10. Thus, no jetting action will damage the sealing elements 10 upon disengaging the protective seal and closing the valve 1.

In addition to the valve 1 described above, the sealing device of the present disclosure may be useful with any number of valves or flow control apparatuses and in a variety of configurations. In some embodiments, the sealing device may be employed in a valve where the flow control element and the protective member are arranged external to the housing. In other embodiments, the first and second fluid volumes may comprise tanks, vessels, bodies of water, or another fluid volume. In some embodiments, the protective member may be positioned in any orientation relative to the flow control element. In one embodiment, the features of the sealing device may be arranged in a circumferential configuration, rather than linear. In another embodiment, the apparatus may include a second positioning device for controlling the position of the protective member. In some embodiments, the flow control element may be a sleeve, a ball, a plug, a solid cylinder, a sliding plank, or other structure, configured to open or close an opening between two or more fluid volumes. In these embodiments, the housing may also be configured in any shape which allows communication with the two or more fluid volumes, including a portion of a plate or wall between two fluid volumes. The features of the sealing device, including the flow control element and the protective member, may be arranged to move translationally, rotationally, rotationally and translationally, or in some other manner.

In various embodiments, the sealing element may be comprised of an o-ring, as described above, or another suitable sealing element known in the art. The sealing element may be arranged on the flow control element, as discussed above, or on the housing. The shape of the sealing element, toroid or otherwise, and the selected material may be chosen from those sealing surfaces known in the art, or that may become known in the art. Potential configurations include v-ring-type seal stacks, bonded seals and other arrangements. Suitable materials include, for example, nitrile, VITON™ (proprietary elastomer of DuPont), and other elastomeric and deformable materials used in sealing elements.

Another embodiment of the present disclosure is shown in FIGS. 6A-D, comprising a valve 101 that includes a tubular housing 102. A flow control element 103 having one or more sealing elements 104*a* is arranged opposite a protective element 105 within the tubular housing 102. The protective element 105 also includes one or more sealing elements 104*b*. The tubular housing 102 further comprises one or more openings 106 for connecting a first fluid volume 107, outside the tubular housing 102, with a second fluid volume 108, internal to the flow control element 103 and/or the protective element 105. The flow control element 103 translates within the tubular housing 102 by mechanical device, hydraulic device, or some other mechanism. The protective element 105 is connected to a biasing member (not shown). The protective element 105 is further arranged with a positioning device (not shown) for maintaining the position of the protective element 105 according to the operation of the valve 101.

Figure 6A:
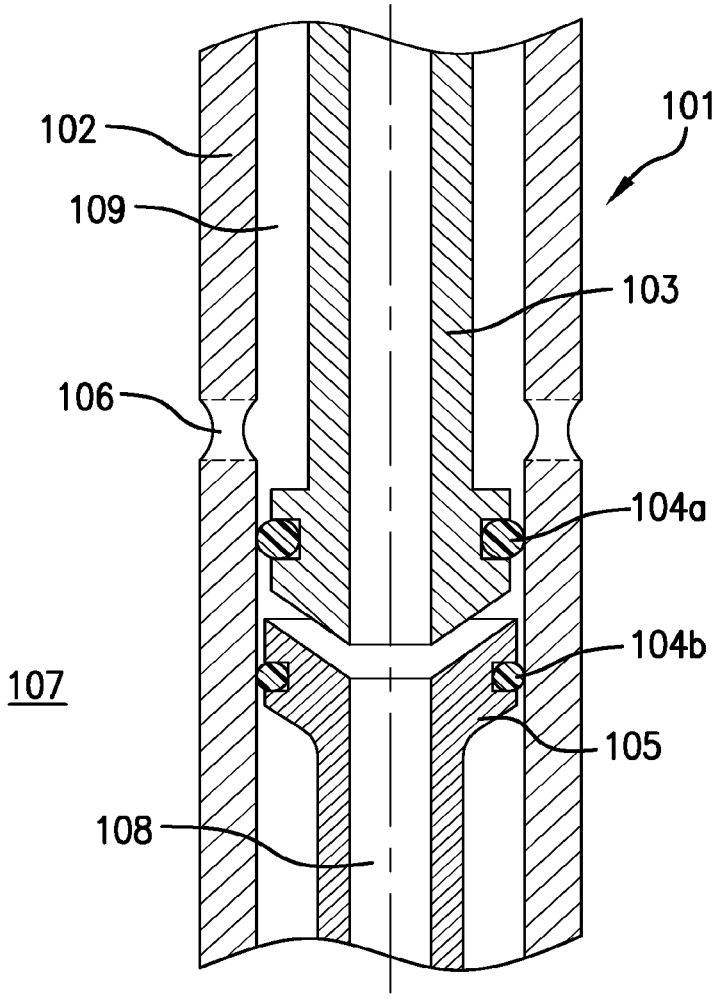
FIGS. 6A-D are sectioned side views of a flow control apparatus in various configurations, according to another embodiment.

The valve 101 operates to open and close fluid communication between the first fluid volume 107 and the second fluid volume 108. FIG. 6A depicts the valve 101 in a closed position, with the openings 106 connecting the first fluid volume 107 with an annular space 109. The annular space 109 of this embodiment is deadheaded but may be used in other configurations to alternatively connect another fluid volume.

The flow control element 103 includes a seating surface 110 that corresponds to a complimentary contact surface 111 on the protective element 105. As used herein, the terms "seat" or "seating surface," as well as the corresponding term "contact surface" are used to differentiate between the features of various elements of the present disclosure, but apply to features which perform the same function. In other words, in various configurations, the "seat" or "seating surface" of the flow control element may be concave or protruding while the "contact surface" of the protective member may be concave or appear to receive the "seating surface." See FIGS. 6B and C.

Figure 6B:
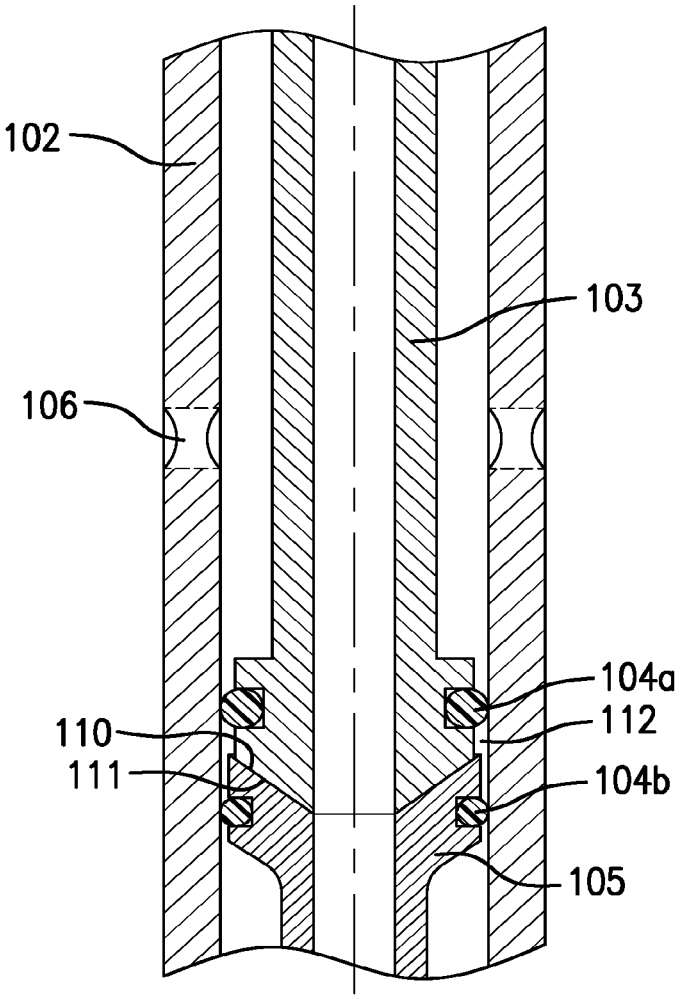
Figure 6C:
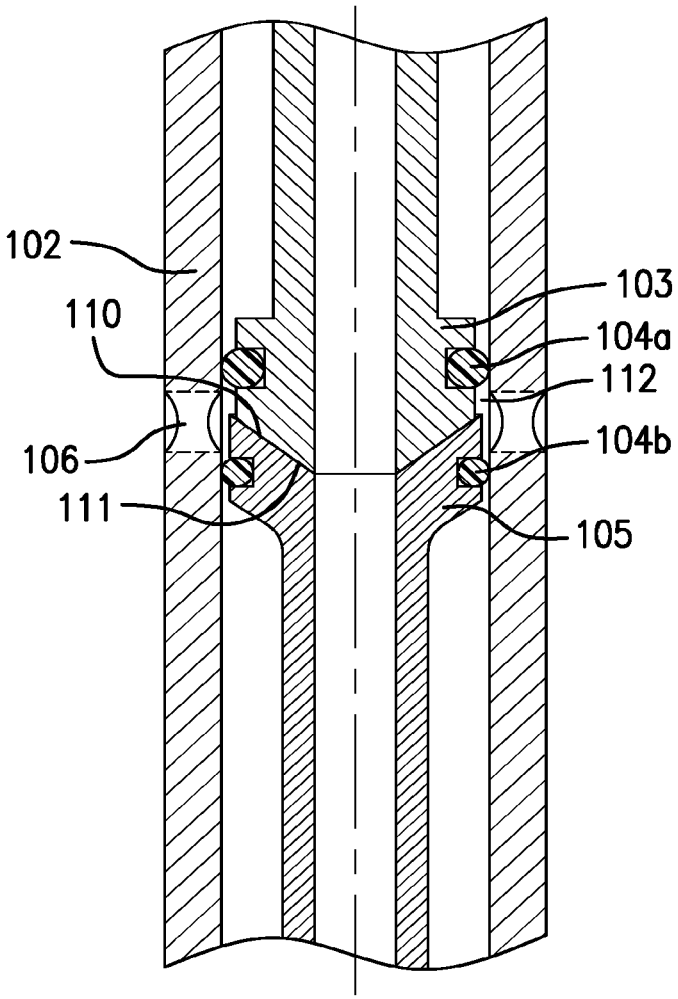

In order to open the valve 101 and protect the sealing elements 104*a*, a protective seal or flow restriction is engaged. As shown in FIG. 6B, the flow control element 103 is moved towards the protective member 105 until the seating surface 110 and the contact surface 111 are engaged. The flow control element 103 continues to engage the protective member 105 until the positioning device releases the force of the biasing member (not shown). With the biasing member engaging the seating surface 110 and the contact surface 111 with sufficient force to maintain the desired protective seal, the flow control element 103 is moved until the sealing elements 104*a* traverse the one or more openings 106, as shown in FIG. 6C. The volume contained between the sealing elements 104*a* and the protective seal formed by seating surface 110 and contact surface 111 comprises an intermediate volume 112, corresponding to the function of the intermediate volume of the embodiments discussed above.

Figure 6D:
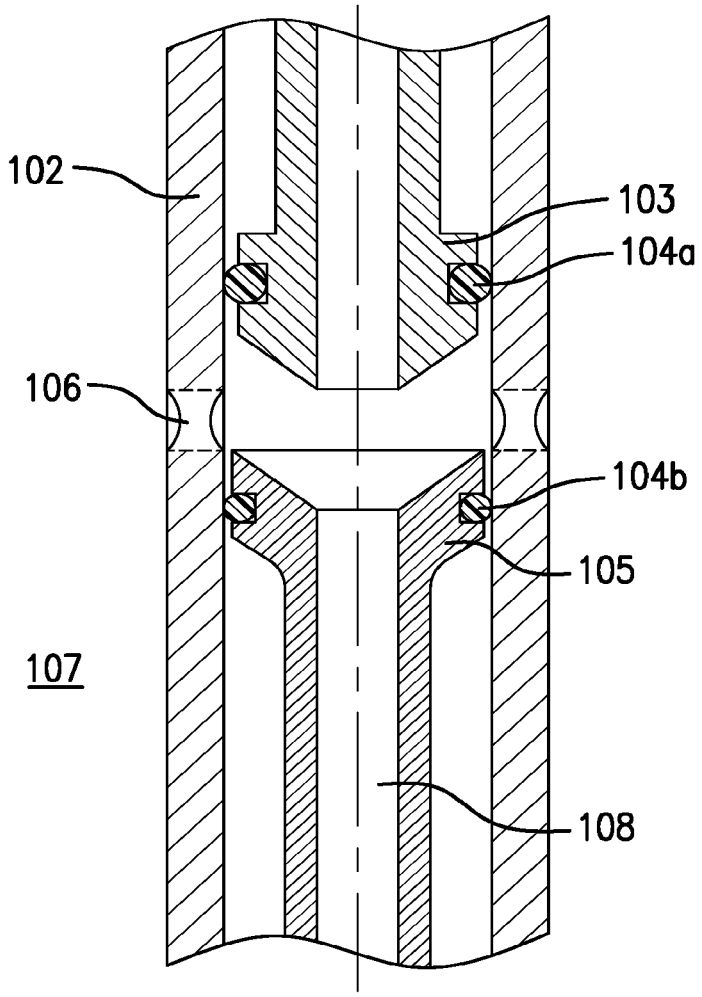

With the valve 101 in the position shown in FIG. 6C, the protective seal may be disengaged without damaging the sealing elements 104*a*, 104*b*. This is done by further moving the flow control element 103 away from the protective member 105, as shown in FIG. 6D. The protective member 105 is maintained in this position, with the sealing elements 104*b* not traversing the one or more openings 106, by the positioning device (not shown).

The valve 101 is closed by reversing the steps discussed above. The flow control element 103 is moved to engage the seating surface 110 with the contact surface 111, see FIG. 6C, whereupon the positioning device releases the biasing member to increase the force of engagement between the seating surface 110 and the contact surface 111. The flow element 103 then continues to move in a direction opposite the force of the biasing member until the sealing elements 104*a* traverse the one or more openings 106 and the fluid connection is deadheaded. See FIG. 6B. Finally, the flow control element 103 and the protective member 105 reach a point at which the positioning device again restrains the biasing member and the valve 101 remains closed. See FIG. 6A.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc., do not denote any order or importance, but rather the terms first, second, etc. are used to distinguish one element from another. Furthermore, the use of the terms a, an, etc. do not denote a limitation of quantity, but rather denote the presence of at least one of the referenced item.

The invention claimed is:

1. A sealing device for separating fluid volumes, comprising:

a housing having one or more openings therein;

a flow control element having one or more sealing elements arranged on the flow control element and movable with the flow control element, the flow control element being arranged within the housing with the one or more sealing elements arranged to contact the housing, the flow control element being configured to move relative to the housing between a closed position and an open position to selectively block fluid communication in the closed position between a first fluid volume exterior of the housing and a second fluid volume interior of the housing, and to selectively permit fluid communication in the open position between the first fluid volume and the second fluid volume via the one or more openings, the one or more sealing elements in contact with a first area of the housing in the closed position, the one or more sealing elements in contact with a second area of the housing in the open position, and the one or more openings in the housing disposed longitudinally between the first and second areas of the housing; and a protective member arranged to engage the flow control element, the protective member restricting fluid communication between the first fluid volume and the second fluid volume when the protective member is engaged with the flow control element;

wherein, when the flow control element is moved between the closed position and the open position, the one or more sealing elements of the flow control element traverse the one or more openings in the housing and the protective member protects the one or more sealing elements from a differential pressure between the first volume and the second volume.

2. The sealing device of claim 1, the flow control element having one or more ports therein.

3. The sealing device of claim 2, wherein the protective member is arranged to obstruct the one or more ports when the protective member is engaged with the flow control element, the protective member is movable relative to the flow control element to selectively reveal the one or more ports, and the protective member is movable with the flow control element when the flow control element moves between the closed position and the open position.

4. The sealing device of claim 1, the protective member further comprising a contact surface and the flow control element further comprising a seat, the contact surface arranged to contact the seat when the protective member is engaged with the flow control element.

5. The sealing device of claim 1, further comprising a biasing member arranged to bias the flow control element towards the protective member, and further comprising a positioning device operatively connected to the biasing member and configured to regulate movement of the flow control element, the positioning device comprising a guide track having a continuous path, extending at least partially circumferentially about the positioning device, and one or more guide pins arranged to follow in the continuous path of the guide track as the guide track and one or more guide pins translate longitudinally and rotate relative to one another.

6. The sealing device of claim 1, wherein the protective member and the one or more sealing elements at least partially define an intermediate volume when the protective member is engaged with the flow control element, the intermediate volume being less than or equal to about 3 cubic inches.

7. The sealing device of claim 1, the protective member being comprised of a metal, a ceramic, or a polymer.

8. The sealing device of claim 1, wherein the position of the protective member or the position of the flow control element is hydraulically or mechanically controllable.

9. A flow control apparatus, comprising:

a housing having one or more openings therein;

a flow control element having a sealing element arranged thereon and movable with the flow control element, the flow control element being arranged within the housing and configured to move relative to the housing between a closed position, isolating a first fluid volume exterior of the housing from a second fluid volume interior of the housing, and an open position, permitting fluid communication between the first fluid volume and the second fluid volume, the sealing element arranged to contact a first area of the housing when the flow control element is in the closed position, the sealing element arranged to contact a second area of the housing when the flow control element is in the open position, and the one or more openings in the housing disposed longitudinally between the first and second areas of the housing; and, a protective member arranged to engage the flow control element, the protective member restricting fluid communication between the first fluid volume and the second fluid volume when the protective member is engaged with the flow control element;

wherein, when the flow control element is moved between the closed position and the open position, the sealing element of the flow control element traverses the one or more openings in the housing and the protective member protects the sealing element from a differential pressure between the first volume and the second volume.

10. The flow control apparatus of claim 9, the protective member further comprising a contact surface and the flow control element further comprising a seating surface, the contact surface arranged to contact the seating surface when the protective member is engaged with the flow control element.

11. The flow control apparatus of claim 9, the flow control element having one or more ports therein.

12. The flow control apparatus of claim 11, wherein the protective member is arranged to obstruct the one or more ports when the protective member is engaged with the flow control element, the protective member is movable relative to the flow control element to selectively reveal the one or more ports, and the protective member is movable with the flow control element when the flow control element moves between the closed position and the open position.

13. The flow control apparatus of claim 9, further comprising a positioning device configured to regulate the movement of the flow control element, the positioning device comprising a guide track having a continuous path, extending at least partially circumferentially about the positioning device, and one or more guide pins arranged to follow in the continuous path of the guide track as the guide track and one or more guide pins translate longitudinally and rotate relative to one another.

14. The flow control apparatus of claim 9, the protective member and the flow control element being comprised of substantially non-deformable materials.

15. The flow control apparatus of claim 9, wherein actuation of the protective member or the flow control element is hydraulically or mechanically controllable.

16. A method using the sealing device of claim 1 for controlling fluid communication between the first fluid volume and the second fluid volume, the method comprising:

forcibly engaging the flow control element with the protective member in opposition to a force exerted by a biasing member, thereby restricting fluid communication between the first fluid volume and the second fluid volume;

moving the flow control element and the protective member with respect to the housing, the one or more sealing elements of the flow control element traversing the one or more openings of the housing;

and disengaging the protective member from the flow control element.

17. The method of claim 16, further comprising repeating the steps of forcibly engaging the flow control element with the protective member, moving the flow control element and protective member, and disengaging the protective member from the flow control element, the performance of which alternatingly opens or closes fluid communication between the first fluid volume and the second fluid volume.

18. The method of claim 16, further comprising equalizing pressure in a volume formed between the sealing element and the protective member.

* * * * *